United States Patent [19]

Wallace

[11] 4,157,240

[45] Jun. 5, 1979

[54] CANDLE SUPPORT BRACKET

[76] Inventor: Robert S. Wallace, 823 S. Longwood Ave., Los Angeles, Calif. 90005

[21] Appl. No.: 826,479

[22] Filed: Aug. 22, 1977

[51] Int. Cl.[2] ..... F23D 3/16

[52] U.S. Cl. ..... 431/297

[58] Field of Search ..... 431/297, 289

[56] References Cited

U.S. PATENT DOCUMENTS

| | | | |
|---|---|---|---|
| 1,647,898 | 11/1927 | Bearse | 431/297 |
| 3,918,888 | 11/1975 | Clark et al. | 431/297 |

*Primary Examiner*—Carroll B. Dority, Jr.

*Attorney, Agent, or Firm*—William W. Haefliger

[57] ABSTRACT

A bracket for snugly supporting the lower portion of a candle stem in a receptacle bore that opens upwardly, to prevent stem wobble, comprising a. a base receivable downwardly in the receptacle bore, and b. multiple upwardly projecting arms generally circularly spaced apart about a central upright axis passing through the center of the base, the arms carried by the base to be deflected by the receptacle bore relatively inwardly toward and into variable snug engagement with said stem lower portion, as the candle lower portion is inserted into said bore.

8 Claims, 8 Drawing Figures

CANDLE SUPPORT BRACKET

BACKGROUND OF THE INVENTION

This invention relates generally to candle supports, and more particularly concerns an improved and very simple bracket for snugly supporting the lower portion of a candle stem on a receptacle bore, to prevent candle wobble.

Candle wobble or looseness in holder bores is a continual annoyance and problem. Prior devices to prevent it included such expedients as tapes and insert pads; however, none of these completely solved the problem, and they were less than satisfactory in use and application; for example, they did not automatically and correctly adjust to different size bores and candle diameters.

SUMMARY OF THE INVENTION

It is a major object of the invention to provide a simple bracket that will easily and positively support a candle lower portion in a holder bore, and which is self-adjusting to the bore and candle as the latter is inserted into the bore, Basically, the bracket comprises (a) a base receivable downwardly in the receptacle bore, and (b) multiple upwardly projecting arms generally circularly spaced apart about a central upright axis passing through the center of the base, and the arms carried by the base to be deflected by the receptacle bore relatively inwardly toward and into variable snug engagement with said stem lower portion, as the candle lower portion is inserted into said bore.

As will appear, the arms may define projections extending relatively inwardly toward the stem lower portion to bite into the candle wax as the arms are deflected inwardly during downward insertion of the stem into the holder; the projections may define longitudinal fins that have sharp inwardly facing edges; the bracket may have one-piece molded plastic construction, to provide three swingable arms with hinged connection to the base; and the base may have lightweight, perforate construction.

These and other objects and advantages of the invention, as well as the details of an illustrative embodiment, will be more fully understood from the following description and drawings, in which:

DRAWING DESCRIPTION

DETAILED DESCRIPTION

Figure 4:
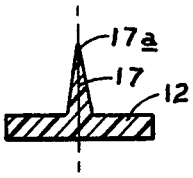
FIG. 4 is an enlarged cross-section on lines 4—4 of FIG. 1.
Figure 1:
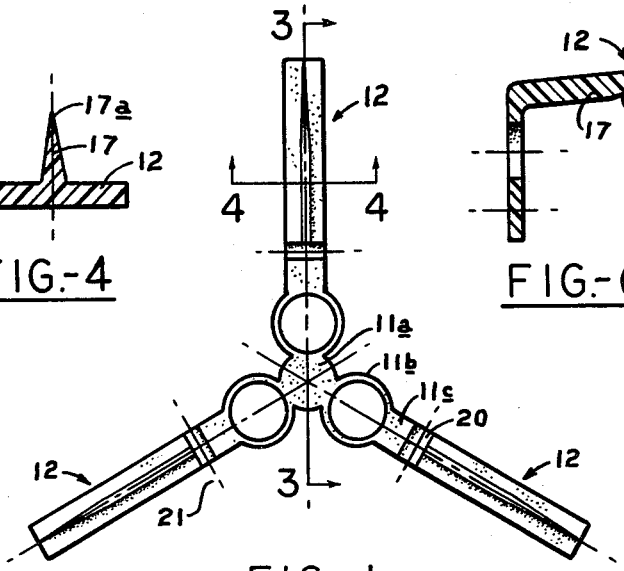
FIG. 1 is a plan view of a candle support bracket in as molded condition.
Figure 6:
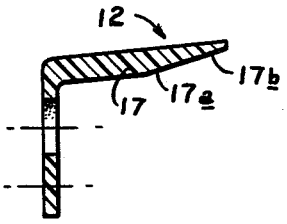
FIG. 6 is an enlarged section on lines 6—6 of FIG. 5.
Figure 5:
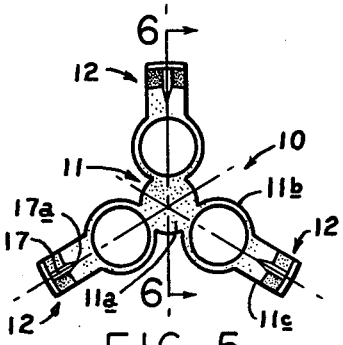
FIG. 5 is a plan view of the final bracket configuration.
Figure 7:
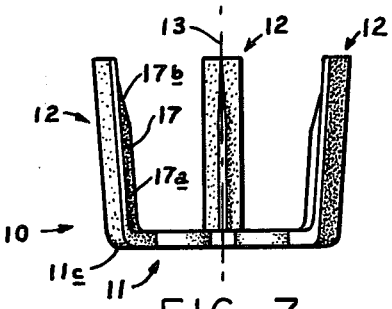
FIG. 7 is a frontal elevation of the FIG. 5 bracket.
Figure 2:
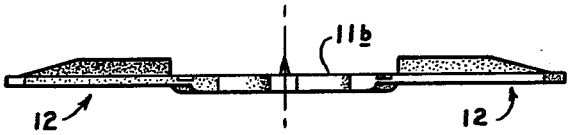
FIG. 2 is a frontal elevation of the FIG. 1 bracket.
Figure 3:
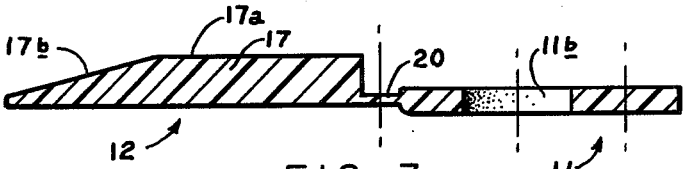
FIG. 3 is an enlarged section on lines 3—3 of FIG. 1.

Referring first to FIGS. 5–7, the bracket 10 basically comprises a base 11 receivable downwardly in a receptacle bore, and multiple upwardly projecting arms 12 generally circularly spaced apart about a central upright axis 13 passing through the center of the base. Also referring to FIG. 8, the arms are carried by the base to be deflected by the bore 14 of a candle receptacle or holder 15 in a relatively inward direction (i.e. toward axis 13) toward and into variable snug engagement with the waxy stem lower portion 16*a* of candle 16, as that lower portion is inserted into the bore. Accordingly, the candle is then snugly supported by the holder, via the bracket, to prevent stem wobble.

Figure 8:
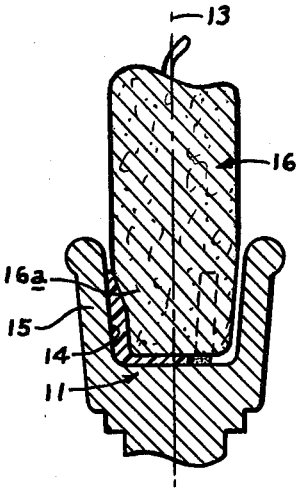
FIG. 8 is a vertical section showing the bracket in use.

More specifically, the bracket arms define projections extending inwardly relatively toward the candle stem lower portion 16*a* to variably and progressively bite into the candle wax as the arms are relatively inwardly deflected by bore 14, upon downward insertion of the candle and bracket into the bore. The projections, which may be defined as fins 17, extending longitudinally of the arms, centrally thereof, and projecting narrowly inwardly to form knife edges 17*a;* further, the upper extents of the fins taper outwardly at 17*b,* to meet the inner sides of the arms upper extents, as shown in FIG. 7. The fins facilitate biting into the candle wax, as shown in FIG. 8. Note that, in FIGS. 7 and 8, the arms taper somewhat in a downward direction, to generally match the taper of the candle lower portion.

The base is seen to have perforate construction, and may include a center portion 11*a;* multiple rings 11*b* outwardly of the center portion 11*a* and attached thereto; and elbows at 11*c* integral with the lowermost extents of the arms.

The bracket may advantageously consist of plastic material, molded as one piece, and forming three arms equally spaced about the central axis.

FIGS. 1–4 show the bracket in originally molded condition, with the arms extending generally in the plane of the bore. A "living"hinge 20 is formed as a connection of each arm to the base, the hinge being very thin and capable of permanent deformation, when heated, to allow permanent up-folding of the arms, in production. The fold axes at the three hinges are indicated at 21, in FIG. 1.

I claim:

1. A bracket for snugly supporting the lower portion of a candle stem in a receptacle bore that opens upwardly, to prevent stem wobble, comprising (a) a base receivable downwardly in the receptacle bore, and (b) multiple upwardly projecting arms generally circularly spaced apart about a central upright axis passing through the center of the base, the arms carried by the base to be deflected by the receptacle bore relatively inwardly toward and into variable snug engagement with said stem lower portion, as the candle lower portion is inserted into said bore, the base being perforate between the center of the base and the lower end of each arm, (c) said arms defining elongated projections extending relatively inwardly toward the candle stem lower portion to bite into the candle was as the arms are relatively inwardly deflected, as described, said projections extending lengthwise of said arms, and having sharp inwardly facing edges.

2. The bracket of claim 1 wherein said projections define fins that have said sharp inwardly facing edges.

3. The bracket of claim 1 wherein said bracket has one-piece molded plastic construction.

4. The bracket of claim 1 wherein there are three of said arms equally spaced about said axis.

5. The bracket of claim 3 wherein said arms have hinged connection to the base.

6. The bracket of claim 2 wherein said base defines rings between the center of the base and the lower ends of the arms.

7. The bracket of claim 1 including said candle stem lower portion in combination therewith.

8. The bracket of claim 7 including said receptacle in combination with said bracket and candle.

* * * * *